US009951734B2

(12) United States Patent
Oki

(10) Patent No.: US 9,951,734 B2
(45) Date of Patent: Apr. 24, 2018

(54) ACTUATOR EQUIPPED COMPONENT

(71) Applicant: DENSO CORPORATION, Kariya, Aichi-pref (JP)

(72) Inventor: Naoto Oki, Kariya (JP)

(73) Assignee: DENSO CORPORATION, Kariya (JP)

( * ) Notice: Subject to any disclaimer, the term of this patent is extended or adjusted under 35 U.S.C. 154(b) by 125 days.

(21) Appl. No.: 14/924,800

(22) Filed: Oct. 28, 2015

(65) Prior Publication Data

US 2016/0222934 A1 Aug. 4, 2016

(30) Foreign Application Priority Data

Jan. 29, 2015 (JP) ..... 2015-15119

(51) Int. Cl.
*F02M 59/10* (2006.01)
*F02M 59/02* (2006.01)

(52) U.S. Cl.
CPC ..... *F02M 59/102* (2013.01); *F02M 59/025* (2013.01)

(58) Field of Classification Search
CPC .... F02M 59/102; F02M 59/025; F16H 25/08; Y02T 74/2107
See application file for complete search history.

(56) References Cited

U.S. PATENT DOCUMENTS 5,327,860 A * 7/1994 Kruger ..... F01L 1/25 123/90.48
5,676,098 A * 10/1997 Cecur ..... F01L 1/143 123/90.33
6,216,583 B1 4/2001 Klinger et al.
7,793,583 B2 * 9/2010 Radinger ..... F01L 1/143 74/569
9,243,521 B2 * 1/2016 Cornett ..... F01L 1/14
2013/0160602 A1 * 6/2013 Chambonneau ..... F16H 25/08 74/569
2013/0202466 A1 8/2013 Makino
2016/0186708 A1 * 6/2016 Vu ..... F02M 59/102 417/364
2017/0299037 A1 * 10/2017 Abrahamson ..... F02M 59/102

FOREIGN PATENT DOCUMENTS

JP H02-215966 A 8/1990
JP 2001-221131 A 8/2001
JP 2007-078072 A 3/2007

* cited by examiner

*Primary Examiner* — David Hamaoui

(57) ABSTRACT

An actuator includes a roller, a roller pin, and a tappet. The roller is in contact with the cam. The roller pin rotationally supports the roller. The tappet is connected with the roller via the roller pin and is integrally movable with the roller and the roller pin. The tappet is movable back and forth integrally with an actuated object. The tappet has an accommodation chamber and a roller releasing portion. The accommodation chamber rotationally accommodates the roller. The roller releasing portion is located inside an inner wall of the accommodation chamber to restrict the tappet from making contact with an outer periphery of the roller. The roller releasing portion has a reinforcing rib in a recessed curved shape. The reinforcing rib is projected from a reference surface of the inner wall of the accommodation chamber toward the roller.

4 Claims, 7 Drawing Sheets

ACTUATOR EQUIPPED COMPONENT

CROSS REFERENCE TO RELATED APPLICATION

This application is based on reference Japanese Patent Application No. 2015-015119 filed on Jan. 29, 2015, the disclosure of which is incorporated herein by reference.

TECHNICAL FIELD

The present disclosure relates to an actuator equipped component, which is configured to actuate an actuated object for an internal combustion engine.

BACKGROUND

Conventionally, an actuator equipped component may actuate an actuated object equipped in an internal combustion engine such as a diesel engine. For example, Patent Document 1 discloses a supply pump as an example of the actuator equipped component. The supply pump in Patent Document 1 is equipped with an actuator, which actuates a plunger to move back and forth inside a cylinder. An actuator may have a stress concentric portion in which stress concentration may occur. It may be desirable to mitigate stress concentration in a stress concentric portion of a component of an actuator to enhance durability of the component.

PATENT DOCUMENT 1

Publication of unexamined Japanese patent application No. H2-215966.

SUMMARY

It is an object of the present disclosure to produce an actuator equipped component configured to mitigate stress concentration in a stress concentric portion of a tappet to enhance durability of the tappet, while maintaining mountability of the actuator equipped component to a vehicle or to an internal combustion engine.

FIG. 7 shows an example of a configuration of a supply pump. The supply pump in FIG. 7 is a generally used plunger pump. The supply pump includes a camshaft, a cam, and an actuator. The camshaft is rotated in synchronization with rotation of an engine output shaft. The cam is equipped to the camshaft. The actuator converts a rotary motion of the cam into a reciprocating motion of a plunger to actuate the plunger.

The actuator includes a roller, a roller pin, a roller bush, a tappet 101, a spring seat, a coil spring, and/or the like. The roller is in contact with a profile (cam surface) of the cam. The roller pin rotationally supports the roller. The roller bush is located between the roller and the roller pin. The tappet 101 transmits the reciprocating motion of the roller to the plunger. The spring seat is connected with the plunger and is movable integrally with the plunger. The coil spring biases the plunger onto the tappet 101 via the spring seat. The tappet 101 has a roller accommodation chamber 102 and a roller releasing portion 103. The roller accommodation chamber 102 rotationally accommodates the roller. The roller releasing portion 103 is formed by an inner wall of the roller accommodation chamber 102 to avoid contact with an outer periphery of the roller. The tappet 101 includes pin holder portions 104 to hold projected shaft portions of the roller pin on both sides. The roller releasing portion 103 includes a straight portion 105 in a flat shape. The roller releasing portion 103 is formed to surround the roller accommodation chamber 102. An inner wall surface of the roller accommodation chamber 102 of the tappet 101 defines a reference surface (baseline, base face) of the inner wall of the roller accommodation chamber 102.

When the plunger moves upward to pressurize fuel, the plunger is applied with a fuel pressurization load, and the fuel pressurization load is transmitted to the tappet 101. Therefore, the tappet 101 receives a large concentric load at a contact portion with the plunger. The contact portion is exemplified as a partition portion 43 in FIG. 5. An arrow A in FIG. 5 exemplifies the concentric load. The tappet 101 bears the concentric load, which is from the plunger, at the pin holder portions 104. Moreover, the roller is applied with a cam contact load, and the cam contact load is transmitted to the contact portion of the tappet 101 via the pin holder portions 104. The contact portion is exemplified as a partition portion (partition wall) 43 in FIG. 5. Therefore, the tappet 101 may deform to be enlarged outward in the direction of the rotational axis of the roller. The cam contact load is exemplified with arrows B in FIG. 5. When the tappet 101 deforms in this way, stress concentration may occur in a stress concentric portion 106 of the tappet 101. The stress concentric portion 106 is a portion surrounded by the dashed line in FIGS. 7A and 7B. Consequently, durability of the tappet 101 may be reduced. In order to avoid reduction in durability of the tappet 101 as described in the example, it may be assumable to increase a thickness of the tappet 101 in the vertical direction in the drawing along the movable direction of the plunger. In this way, the tappet 101 may be protected from deformation to mitigate the stress concentration caused in the stress concentric portion 106 of the tappet 101.

It is noted that, in a configuration where the thickness of the tappet 101 is increased to reduce stress, the roller releasing portion 103 may interfere with the outer periphery of the roller. Consequently, the roller position needs to be offset. Consequently, in a conventional supply pump, the plunger actuator of the supply pump may be enlarged in the vertical direction along the movable direction of the plunger. Consequently, mountability of the plunger actuator to an engine or to an engine room of a vehicle may be impaired. For example, in a case where a supply pump is directly equipped to an engine cylinder block, the supply pump may not be equipped within a limited space of the cylinder block.

According to an aspect of the invention, an actuator equipped component comprises a camshaft including a cam configured to be rotated by an internal combustion engine. The actuator equipped component further comprises an actuated object movable back and forth along a shape of the cam. The actuator equipped component further comprises an actuator configured to convert a rotary motion of the cam into a reciprocating motion of the actuated object and to actuate the object to move back and forth. The actuator includes a roller in contact with the cam. The actuator further includes a roller pin rotationally supporting the roller. The actuator further includes a tappet connected with the roller via the roller pin and integrally movable with the roller and the roller pin, the tappet movable back and forth integrally with the actuated object. The tappet has an accommodation chamber rotationally accommodating the roller. The tappet further has a roller releasing portion located inside an inner wall of the accommodation chamber and configured to restrict the tappet from making contact with an outer periphery of the roller. The roller releasing portion has a reinforcing rib in a recessed curved shape. The reinforcing rib is projected from a reference surface of the inner wall of the accommodation chamber toward the roller.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, embodiments of the present disclosure will be described in detail with reference to drawings.

EMBODIMENTS

Configuration of First Embodiment

Figure 1:
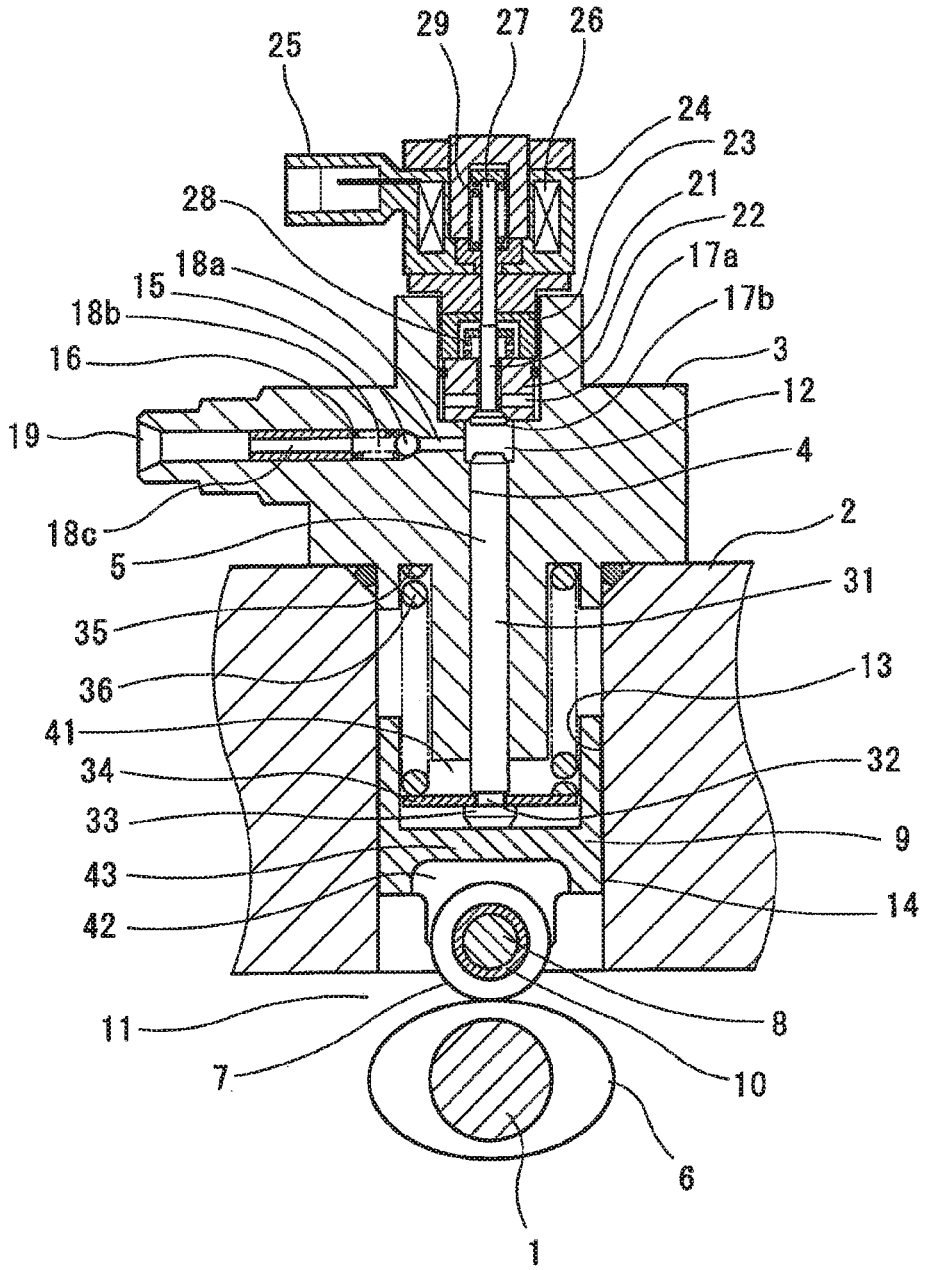
FIG. 1 is a sectional view showing a supply pump equipped with a plunger actuator according to a first embodiment.

FIGS. 1 to 3 show a supply pump according to a first embodiment. The supply pump is equipped with a plunger actuator of the present disclosure.

A fuel supply apparatus according to the present embodiment is configured with a common-rail fuel injection system. The common-rail fuel injection system is known as a fuel injection system, which is for, for example, an internal combustion engine (vehicular engine of engine) such as a diesel engine. The engine may be equipped in an engine room of a vehicle such as an automobile. The common-rail fuel injection system includes a fuel filter, a low-pressure fuel pump (feed pump), a supply pump, a common rail, and multiple fuel injection valves (injectors).

The supply pump may be equivalent to an actuator equipped component. The supply pump is a high-pressure fuel pump including a plunger and a cylinder barrel, which is in a tubular shape. The plunger is movable back and forth in the cylinder barrel thereby to pressurize fuel drawn into a fuel compression chamber in the cylinder barrel and to discharge the compressed fuel. The supply pump includes a camshaft 1 and a housing 2. The camshaft 1 rotates in synchronization with rotation of a crankshaft of an engine in the constant direction. The housing 2 rotationally supports the camshaft 1.

The supply pump includes a cylinder body 3, a plunger 5, and a plunger actuator. The cylinder body 3 is screwed and affixed to an upper portion of the housing 2 by using a fastener such as a bolt. The plunger 5 is movable back and forth in the cylinder barrel 4 of the cylinder body 3. The plunger actuator actuates the plunger 5 in a vertical direction. The plunger actuator includes a tappet roller 7, a roller pin 8, a tappet body 9, a roller bush 10, and/or the like. The tappet roller 7 is in contact with an outer periphery (cam profile) of a cam 6 of the camshaft 1. The roller pin 8 rotationally supports the tappet roller 7. The tappet body (tappet) 9 is connected with the tappet roller 7 via the roller pin 8 and is integrally movable with the tappet roller 7 and the roller pin 8. The roller bush 10 is located between the tappet roller 7 and the roller pin 8. Detail of the plunger actuator will be described later.

The camshaft 1 is driven and rotated with the crankshaft of the engine. The camshaft 1 is rotationally supported by the housing 2 via two metal bushes (not shown). An outer circumferential periphery of the camshaft 1 is integrally equipped with at least one cam 6, which has a cam peak. The cam 6 and the camshaft 1 are rotationally accommodated in a camshaft accommodation chamber 11 of the housing 2. The camshaft 1 is connected with the crankshaft of the engine such that the camshaft 1 rotates by one revolution while the crankshaft rotations by two revolutions.

The housing 2 and an outer periphery of the cylinder body 3 define a fuel gallery (not shown) in an annular shape. The fuel gallery is to supply fuel through a fuel inlet passage into a fuel compression chamber 12. The fuel gallery draws fuel from the feed pump through an inlet port (intake port: not shown) of the supply pump. The housing 2 internally forms a tappet guide 13 in annular shape. The tappet guide 13 has an inner circumferential periphery defining a slidable surface on which an outer periphery of the tappet 9 is slidable. The plunger 5 is movable back and forth in a vertical direction. The tappet guide 13 internally forms a tappet accommodation chamber 14, which accommodates the plunger actuator. The plunger actuator actuates the plunger 5 to move the plunger 5 in the vertical direction. An interior of the tappet accommodation chamber 14 temporarily accumulates oil to lubricate various lubricated portions of the plunger actuator.

The engine includes a cylinder block and a cylinder head. The cylinder block forms multiple cylinders. The cylinder head is affixed to an upper portion of the cylinder block. The engine further includes a crankcase and an oil sump. The crankcase is formed in a lower portion of the cylinder block. The oil sump is formed integrally with a lower portion of the crankcase. The housing 2 is integrated with the cylinder head or the cylinder block of the engine. Specifically, the housing 2 is integrally formed with the cylinder head or the cylinder block of the engine. Alternatively, the housing 2 is screwed and affixed to the cylinder head or a pump attachment portion of the cylinder block of the engine by using a fastener such as a bolt.

The cylinder body 3 has a cylinder barrel 4 in a tubular shape. The plunger 5 has a sliding surface slidable in the cylinder barrel 4. The cylinder barrel 4 may be equivalent to a cylinder. The cylinder barrel 4 has one end side in an axial direction, and the one end side defines the fuel compression chamber 12. The fuel compression chamber 12 is located outside the cylinder barrel 4 in the radial direction of the camshaft 1. The supply pump is a plunger pump in which the plunger 5 is movable back and forth in the cylinder barrel 4 of the cylinder body 3, thereby to compresses fuel and discharge the compressed fuel from the fuel gallery through the fuel intake passage into the fuel compression chamber 12.

The cylinder body 3 has an affixed portion (join portion) in a tubular shape. The affixed portion is equipped with a solenoid valve by, for example, screwing. The affixed portion has a female screw hole (accommodating recessed portion) opening to the outside. The cylinder body 3 has an affixed portion (join portion) in a tubular shape. The affixed portion is equipped with a pipe joint by, for example, screwing. The affixed portion has a female screw hole (accommodating recessed portion) opening to the outside. The accommodating recessed portion has a bottom side (compression chamber side) accommodating a valve element 15 and a fuel discharge valve. The valve element (valve) 15 opens and closes a fuel discharge passage on a downstream of the fuel compression chamber 12. The fuel discharge valve has a check valve configuration including a return spring 16, which biases the valve 15 in a closing direction.

The fuel intake passage has a fuel intake hole (not shown), a fuel intake hole 17*a*, a valve accommodation chamber 17*b*, and/or the like. The fuel intake hole (not shown) communicates with the fuel gallery. The fuel intake hole 17*a* communicates with the fuel intake hole (not shown). The valve accommodation chamber 17*b* communicates the fuel intake hole 17*a* with the fuel compression chamber 12. The fuel discharge passage has a fuel discharge hole 18*a*, a discharge valve accommodation chamber 18*b*, a fuel discharge hole 18*c*, an outlet port (discharge port) 19, and/or the like. The fuel discharge hole 18*a* communicates with the fuel compression chamber 12. The discharge valve accommodation chamber 18*b* communicates with the fuel discharge hole 18*a*. The fuel discharge hole 18*c* communicates with the discharge valve accommodation chamber 18*b*. The discharge port 19 opens to the outside.

The solenoid valve is an electromagnetic flow control valve (PCV), which has a normally-close type configuration. The solenoid valve controls a quantity of fuel pressure-fed from a discharge port of the supply pump to the common rail. The solenoid valve includes a spool valve 21 and a valve body 22. The spool valve 21 is movable back and forth in the axial direction. The valve body 22 accommodates the spool valve 21 such that the spool valve 21 is slidable in the valve body 22. The spool valve 21 is a valve element of the solenoid valve. The spool valve 21 opens and closes the fuel intake passage, which communicates the fuel gallery with the fuel compression chamber 12. The valve body 22 has a lower end surface on the lower side in the drawing, and the lower end surface is equipped with a valve seat (valve seat surface). The valve seat forms a conical surface in a tapered shape and regulates a full-close position of the solenoid valve. A valve portion of the spool valve 21 is seated on the valve seat surface.

The solenoid valve includes a solenoid actuator (solenoid), which actuates the spool valve 21 in an opening direction. The solenoid is accommodated in housings 23 and 24, which are connected to an upper portion of the valve body 22. The solenoid includes a connector 25 for external connection. The solenoid is configured such that the solenoid is controlled with a pump driving electric current supplied from an engine control unit (electronic control unit: ECU). The solenoid includes a coil 26, an inner-coil core, an outer-coil core, an armature 27, and/or the like. The coil 26 is wound around an outer circumferential periphery of a bobbin. The inner-coil core is located on the radially inside of the coil. The outer-coil core is located on the radially outside of the coil. The armature 27 is movable back and forth in the stator core.

The coil 26 generates magnetism to draw the armature 27 to a magnetic pole surface of the inner-coil core when supplied with electric power. That is, the coil 26 generates the magnetism when applied with a voltage and energized. An interior of the housings 23 and 24 accommodate coil springs 28 and 29, respectively. The coil springs 28 and 29 bias the spool valve 21 and the armature 27, respectively, in a closing direction of the spool valve 21. An outer circumferential periphery of the housing 23 has a male screw. An inner circumferential periphery of a fastener portion of the cylinder body 3 has a female screw hole. The male screw of the housing 23 is meshed with the female screw hole of the fastener portion of the cylinder body 3. An outer circumferential periphery of the solenoid valve has a tool fitting portion in a polygonal shape. The tool fitting portion is used when the solenoid valve is screwed to the fastener portion of the cylinder body 3.

The supply pump includes a plunger actuator, which is located between the cam 6 of the camshaft 1 and the plunger 5. The plunger 5 has a middle diameter portion 31, which is inserted into and supported by the cylinder barrel 4. The plunger 5 has a lower end side in the drawing, and the lower end side is equipped with a projected end portion. The projected end portion is projected beyond a lower end surface of the cylinder body 3 in the drawing into the tappet accommodation chamber 14. The projected end portion includes a small diameter portion 32 and a tappet contact portion 33. The small diameter portion 32 is less than the middle diameter portion 31 in the diameter. The tappet contact portion 33 is in a collar shape and is greater than the middle diameter portion 31 in the diameter. A spring seat 34 is equipped to an outer circumferential periphery of the small diameter portion 32.

The cylinder body 3 has a lower end in the drawing, and the lower end is equipped with a spring accommodation hole 35 in a tubular shape. A plunger spring 36 is located between an upper end surface of the spring seat 34 and a bottom side surface of the spring accommodation hole 35. The plunger spring 36 biases the plunger actuator in a direction toward an outer periphery (profile) of the cam 6. A tubular seal member (not shown) is equipped between an outer circumferential periphery of the intermediate portion of the plunger 5 and an inner circumferential periphery of the lower end of the cylinder body 3 in the drawing. The seal member restricts fuel in the fuel compression chamber 12 from flowing through a clearance between the plunger 5 and the cylinder barrel 4 into the tappet accommodation chamber 14. Thus, the seal member restricts contamination of the fuel from contaminating with oil.

Subsequently, details of the plunger actuator according to the present embodiment will be briefly described with reference to FIGS. 1 to 3D. As described above, the plunger actuator includes the tappet roller 7, the roller pin 8, the tappet 9, and/or the like. The tappet roller 7 is rotationally supported by the outer circumferential periphery of the roller pin 8. The tappet roller 7 implements a reciprocal movement along the shape of the cam peak of the cam 6 to move the plunger 5 back and forth. In addition, the tappet roller 7 is directly in contact with the cam peak of the cam 6.

The roller pin 8 is equipped to the tappet roller 7 such that the roller pin 8 extends through the tappet roller 7 in the axial direction. The roller pin 8 includes projected shaft portions 37, which are projected outward beyond both end surfaces of the tappet roller 7, respectively, in a direction of the rotational axis. The projected shaft portions 37 are equipped to both ends of the roller pin 8 in the direction of the rotational axis. It is noted that, when the tappet roller 7 rotates on a circumferential periphery of the roller pin 8 in a circumferential direction, the tappet roller 7 and the roller pin 8 may cause seizure therebetween. Therefore, a tubular roller bush 10 is equipped between an inner circumferential periphery of the tappet roller 7 and the outer circumferential periphery of the roller pin 8.

The tappet 9 is configured to convert a rotary motion of the cam 6 into a reciprocating motion of the plunger 5 in the vertical direction. The tappet 9 is supported by the tappet guide 13 of the housing 2 such that the tappet 9 is slidable on the tappet guide 13 to move back and forth. The tappet 9 is connected with the tappet roller 7 via the roller pin 8 such that the tappet 9 is integrally movable with the tappet roller 7. The tappet 9 is configured to move back and forth together with the plunger 5, the tappet roller 7, and the roller pin 8. The tappet 9 has a plunger accommodation chamber 41 and a roller accommodation chamber 42. The plunger accommodation chamber 41 accommodates the tappet contact portion 33 and the spring seat 34 of the plunger 5. The roller accommodation chamber 42 rotationally accommodates the tappet roller 7. The tappet 9 has a partition portion (partition wall) 43, which partitions the plunger accommodation chamber 41 from the roller accommodation chamber 42. The plunger accommodation chamber 41 is an upward-side space formed on a plunger upward side. The plunger accommodation chamber 41 is formed closer to the plunger 5 than the partition wall 43 of the tappet 9. The roller accommodation chamber 42 is a downward-side space formed on a plunger downward side. The roller accommodation chamber 42 is formed closer to the cam 6 than the partition wall 43 of the tappet 9.

The tappet contact portion 33 of the plunger 5 is directly in contact with an upper surface of the partition wall 43. The partition wall 43 has a blockade portion 44 in a plate shape. The blockade portion 44 blocks an end side of the roller accommodation chamber 42 on the upper side in the drawing. An outer periphery of the tappet 9 including the blockade portion 44 forms a sliding surface, which is slidable on the inner circumferential periphery (sliding surface) of the tappet guide 13 to move back and forth. The tappet 9 has a protruded wall portion (protruded blockade portion) 45 in a tubular shape. The protruded wall portion 45 is protruded or is slightly projected from an outer circumferential periphery of the blockade portion 44 of the partition wall 43 toward the cam 6. The protruded wall portion 45 surrounds an end portion of the roller accommodation chamber 42 in a circumferential direction. The tappet 9 has a roller releasing portion, which avoids contact with the outer periphery of the tappet roller 7. The roller releasing portion is formed by an inner wall of the roller accommodation chamber 42. Specifically, the roller releasing portion is formed by an inner wall of the blockade portion 44 and an inner wall of the protruded wall portion 45. Details of the roller releasing portion according to the present embodiment will be described later.

The tappet 9 has a circumferential sidewall 46 in a tubular shape. The circumferential sidewall 46 is protruded from the outer circumferential periphery of the partition wall 43 toward the plunger 5 side on the upper side in the drawing. The circumferential sidewall 46 internally forms the plunger accommodation chamber 41. The tappet 9 has a pair of supporting walls 47, which are extended from lower ends of the protruded wall portion 45 of the roller releasing portion in the drawing. The supporting walls 47 are extended toward the cam 6. The supporting walls 47 are opposed to each other across the roller accommodation chamber 42. The supporting walls 47 form pin holder portions to hold the projected shaft portions 37 of the roller pin 8, respectively. The pair of supporting walls 47 has insertion holes 48 in which the projected shaft portions 37 are rotationally inserted. It is noted that, the projected shaft portions 37 of the roller pin 8 may be affixed to the supporting walls 47.

The housing 2 according to the present embodiment has an oil supply passage (not shown) to supply engine oil (lubricating oil or oil) discharged from an oil pump to each of the cam 6 of the camshaft 1 and a lubricated portion of the plunger actuator. The partition wall 43 and the protruded wall portion 45 of the tappet 9 form oil supply passages 52 and 53. The oil supply passages 52 and 53 are to supply engine oil (lubricating oil or oil), which is discharged from the oil pump, into the roller accommodation chamber 42.

The roller accommodation chamber 42 of the supply pump is located on the lower side or on the upper side of the camshaft accommodation chamber 11 relative to the gravity direction. The configuration enables the roller accommodation chamber 42 to communicate with an oil storage chamber of the oil sump, which is on the lower side of the crankcase, through the camshaft accommodation chamber 11 and an oil discharge passage (not shown). The plunger actuator has lubricating portions. The lubricating portions are, for example, a contact portion between the tappet contact portion 33 of the plunger 5 and the partition wall 43 of the tappet 9 and/or a contact portion between the cam 6 and the tappet roller 7. The lubricating portions are, for example, a sliding portion (slidable clearance) between the tappet guide 13 and the tappet 9, a sliding portion (slidable clearance) between the tappet roller 7 and the roller bush 10, a sliding portion between the roller pin 8 and the roller bush 10, and/or the like.

Subsequently, details of the roller releasing portion according to the present embodiment will be briefly described with reference to FIGS. 2A to 3D. As shown in FIGS. 2A to 2D and FIGS. 3A and 3B, the roller releasing portion includes a curved recessed portion 61, a straight portion 62, and/or the like. The curved recessed portion 61 forms a gap at a predetermined distance with an outer periphery of the tappet roller 7. The straight portion 62 is in a flat shape located inside the curved recessed portion 61. The straight portion 62 forms a gap at a predetermined distance with the outer periphery of the tappet roller 7. The curved recessed portion 61 has a curved surface having a predetermined curvature radius. The curved recessed portion 61 surrounds a periphery of the straight portion 62. The curved recessed portion 61 has a reinforcing rib 65 in a recessed curved shape. The reinforcing rib 65 is projected (protruded) from a reference surface 64 of the inner wall of the roller accommodation chamber 42 toward the tappet roller 7. The reference surface 64 is in a U-shaped portion represented with dashed lines in FIGS. 2D, 2E, 3A, and 3C. The straight portion 62 is in a circular shape. The straight portion 62 is located at a center of a ceiling surface of the blockade portion 44. The straight portion 62 is located on the bottom side of the roller accommodation chamber 42. Two oil supply passages 53 open in the straight portion 62.

Figure 2A:
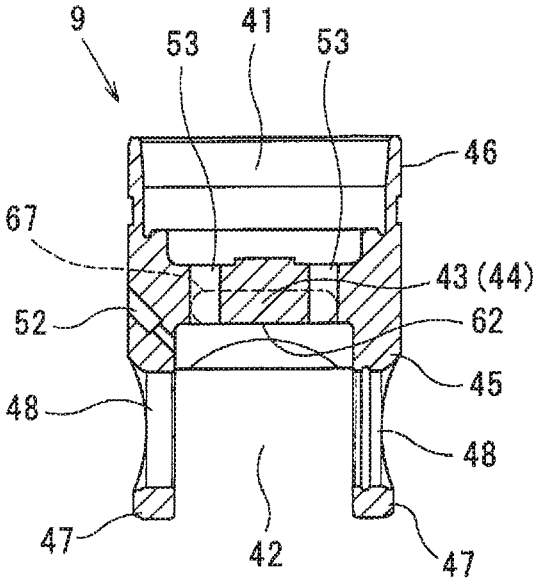
FIGS. 2A and 2B are sectional views each showing a tappet of the plunger actuator according to the first embodiment.
Figure 2B:
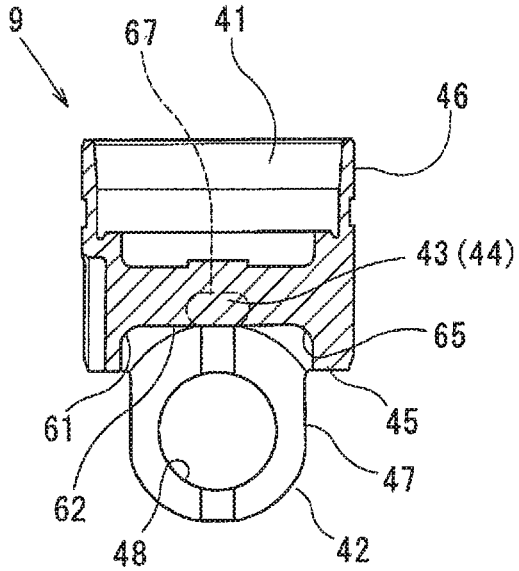
Figure 2C:
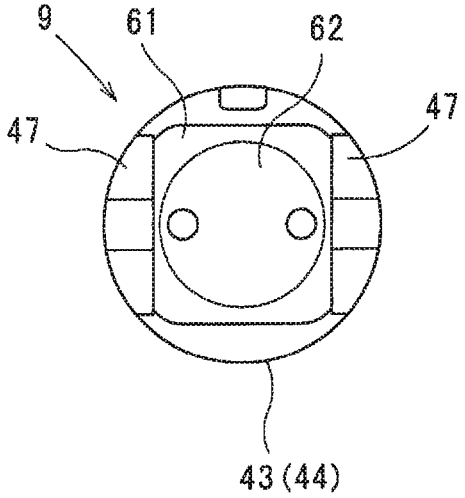
FIG. 2C is a bottom view showing the tappet according to the first embodiment.
Figure 2D:
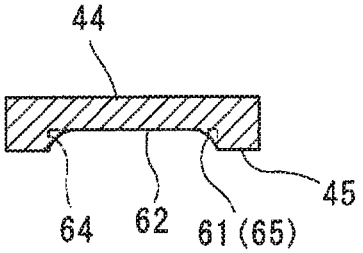
FIGS. 2D and 2E are sectional views each showing a blockade portion of the tappet according to the first embodiment.
Figure 2E:
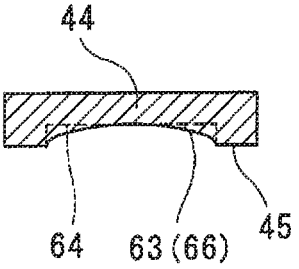
Figure 3A:
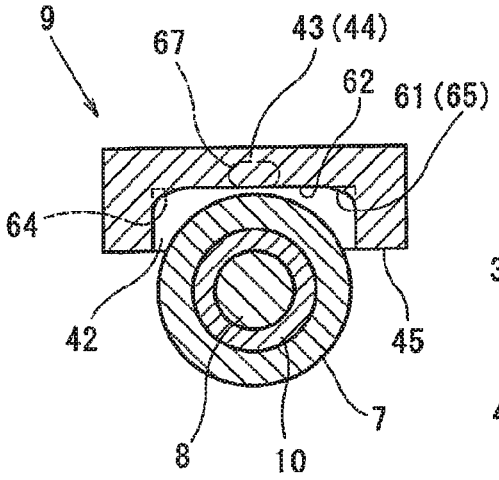
FIGS. 3A to 3D are sectional views each showing the tappet according to the first embodiment.
Figure 3B:
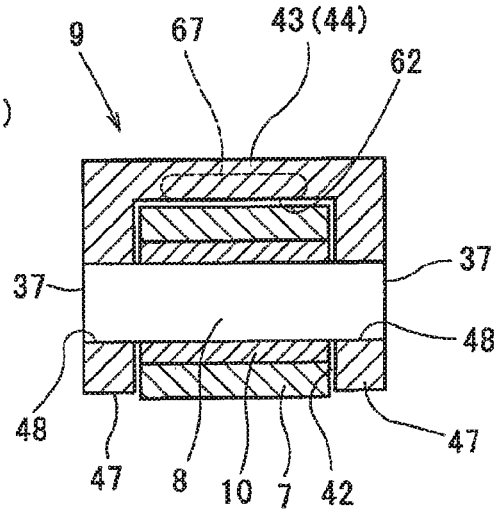
Figure 3C:
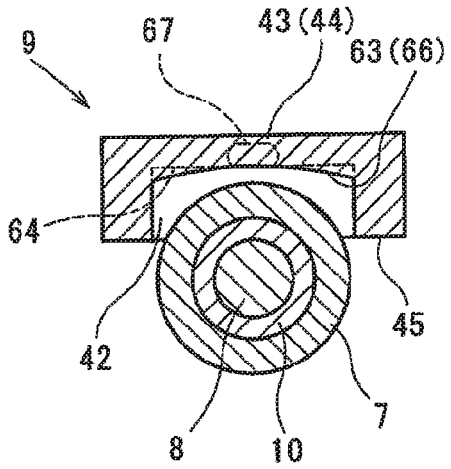
Figure 3D:
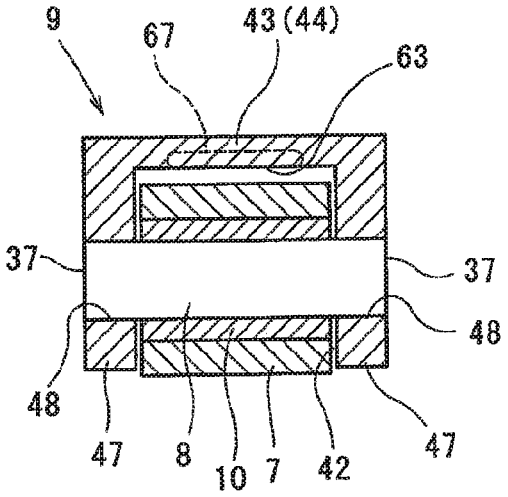

As shown in FIG. 2E and FIGS. 3C and 3D, the roller releasing portion is formed with the curved recessed portion 63 and/or the like. The curved recessed portion 63 forms the gap at a predetermined distance with the outer periphery of the tappet roller 7. The curved recessed portion 63 has a curved surface having a predetermined curvature radius. The curved recessed portion 63 is formed entirely on the ceiling surface of the blockade portion 44 on the bottom side of the roller accommodation chamber 42. The curved recessed portion 63 has the reinforcing rib 65 in the recessed curved shape. The reinforcing rib 66 is projected (protruded) from the reference surface 64 of the inner wall of the roller accommodation chamber 42 toward the tappet roller 7. The reference surface 64 is in the U-shaped portion represented with dashed lines in FIGS. 2D, 2E, 3A, and 3C.

Operation of First Embodiment

Subsequently, operation of the supply pump used for the common-rail fuel injection system according to the present embodiment will be briefly described with reference to FIGS. 1 to 3D.

As the camshaft 1 of the supply pump rotates in synchronization with rotation of the crankshaft of the engine, the tappet roller 7 moves back and forth in the vertical direction along the outer periphery (cam profile) of the cam 6. That is, the tappet roller 7 moves upward and downward to implement vertical motion. The movement of the tappet roller 7 is transmitted to the tappet 9 via the roller pin 8 thereby to move the tappet 9 back and forth inside the tappet accommodation chamber 14 in the vertical direction in the drawing. That is, the tappet 9 moves upward and downward to implement vertical motion. The movement of the tappet 9 is transmitted directly to the plunger 5 thereby to move the plunger 5 back and forth inside the cylinder barrel 4 in the vertical direction in the drawing. That is, the plunger 5 moves upward and downward to implement vertical motion. In the present state, fuel discharged from the feed pump is supplied through the intake port of the supply pump into the fuel gallery.

In a configuration where the plunger 5 moves downward in a fuel intake direction, when the solenoid valve opens, fuel is drawn from the fuel gallery into the fuel intake hole. Subsequently, fuel drawn into the fuel intake hole passes through the fuel intake hole 17*a* and the valve accommodation chamber 17*b* in this order. Thus, the fuel is drawn into the fuel compression chamber 12. Subsequently, the plunger 5 reaches a bottom dead center to invert the moving direction of the plunger 5 to a fuel pressurization direction to move upward again. In the present state, when the solenoid valve is closed, the fuel compression chamber 12 reduces in volume to pressurize fuel in the fuel compression chamber 12. Subsequently, the plunger 5 further moves in the fuel pressurization direction to increase the fuel pressure in the fuel compression chamber 12 to be greater than a valve opening pressure of the fuel discharge valve thereby to open the valve 15 of the fuel discharge valve. In this way, high-pressure fuel is pressure-fed from the fuel compression chamber 12 through the fuel discharge passage into the common rail. Specifically, the high-pressure fuel is fed from the fuel compression chamber 12 to pass through the fuel discharge hole 18*a*, the discharge valve accommodation chamber 18*b*, the fuel discharge hole 18*c*, and the discharge port 19, in this order, into the common rail. Thus, the high-pressure fuel is accumulated in the common rail. The multiple injectors are actuated to open at arbitrary injection timings, thereby to inject the accumulated high-pressure fuel into the engine cylinders, respectively, at predetermined timings.

Fuel is discharged from the fuel compression chamber 12 of the supply pump in a pressure feed stroke. It is noted that, in the pressure feed stroke, fuel in the fuel compression chamber 12 is returned through a fuel intake passage into the fuel gallery, while the solenoid valve opens. More specifically, in a period after the plunger 5 starts moving upward until the solenoid valve closes to start to pressure feed fuel, fuel is returned from the fuel compression chamber 12 to pass through the fuel intake hole, the fuel intake hole 17*a*, and the valve accommodation chamber 17*b*, in this order, into the fuel gallery. This stroke is referred to as a pre-stroke. When the solenoid valve closes, discharge of fuel into the fuel gallery is terminated. A quantity of fuel remaining in the fuel compression chamber 12, when the solenoid valve closes, regulates a fuel discharge quantity (pump discharge quantity or pump pressure feed quantity). The solenoid valve closes at a closing timing, which is a pressure feed start timing. As the closing timing of the solenoid valve is advanced toward the bottom dead center of the plunger 5, a pressure feed time period is increased thereby to increase the pump discharge quantity. Maximum quantity pressure feed is performed to pressure feed fuel at a maximum quantity in a case where the closing timing of the solenoid valve is substantially set at the bottom dead center of the plunger 5.

Effect of First Embodiment

As described above, the tappet 9 of the plunger actuator according to the present embodiment is equipped with the roller releasing portion 61 to 63 and 71 to 73. The roller releasing portion is to avoid contact with the outer periphery of the tappet roller 7. The roller releasing portion 61 to 63 and 71 to 73 is equipped with the reinforcing ribs 65 and 66, each of which is in the recessed curved shape. The reinforcing ribs 65 and 66 are protruded from the reference surface 64 of the inner wall of the roller accommodation chamber 42 toward the tappet roller 7. As shown by an arrow A in FIG. 5, the partition wall 43 of the tappet 9 may receive a large concentric load from the tappet contact portion 33 of the plunger 5. In addition, as shown by arrows B in FIG. 5, the partition wall 43 of the tappet 9 may receive large concentric loads from both ends of a roller pin (tappet roller) 7 in the rotational axis direction. Both the ends of the roller pin 7 may apply the concentric load onto the projected shaft portions 37. Even when the partition wall 43 receives the large concentric loads, the reinforcing ribs 65 and 66 may protect the tappet 9 from deformation, without increasing the thickness of the tappet 9. Therefore, the present configuration may restrict the partition wall 43 of the tappet 9 from deforming to enlarge outward in the rotational axis direction of the tappet roller 7. Therefore, the present configuration may mitigate stress concentration caused at a stress concentric portion 67 of the partition wall 43 of the tappet 9. The stress concentric portion 67 is surrounded by a dashed line in FIGS. 2A and 2B and FIGS. 3A to 3D.

The present configuration may enable to restrict the plunger actuator from enlarging in the vertical direction along the movable direction of the plunger 5 in which the plunger 5 is movable back and forth. Therefore, the present configuration may restrict the supply pump, which is equipped with the plunger actuator, from enlarging in the vertical direction. Thus, the present configuration may enhance a mountability of the supply pump to the vehicle such as mountability in an engine room, mountability to a body of the engine, and/or the like. For example, the present configuration may enable the supply pump to be mounted in a limited space such as a space around a cylinder block of the engine. In addition, the present configuration may mitigate a stress applied to the stress concentric portion 67 of the tappet 9 thereby to enhance durability of the tappet 9, while maintaining the mountability of the supply pump to a vehicle such as an automobile, an engine, and/or the like.

Configuration of Second Embodiment

FIG. 4 shows a tappet equipped in a plunger actuator of a supply pump according to a second embodiment of the present disclosure.

Similarly to the first embodiment, the tappet 9 according to the present embodiment includes the blockade portion 44 and the protruded wall portion 45. The blockade portion 44 is in a plate shape to cover the end of the roller accommodation chamber 42 on the upper side in the drawing. The protruded wall portion 45 is in the tubular shape and is protruded or slightly projected from the outer circumferential periphery of the blockade portion 44 toward the cam 6. The protruded wall portion 45 surrounds the end of the roller accommodation chamber 42 in the circumferential direction. The roller releasing portion of the tappet 9 is formed by the inner wall of the roller accommodation chamber 42. Specifically, the roller releasing portion is formed by the inner wall of the blockade portion 44 and the inner wall of the protruded wall portion 45.

Figure 4A:
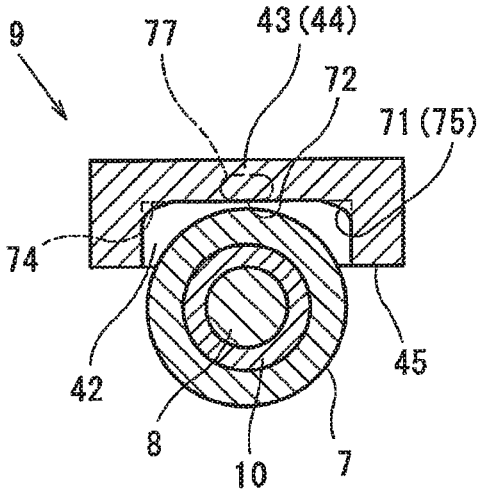
FIGS. 4A to 4D are sectional views each showing the tappet according to a second embodiment.
Figure 4B:
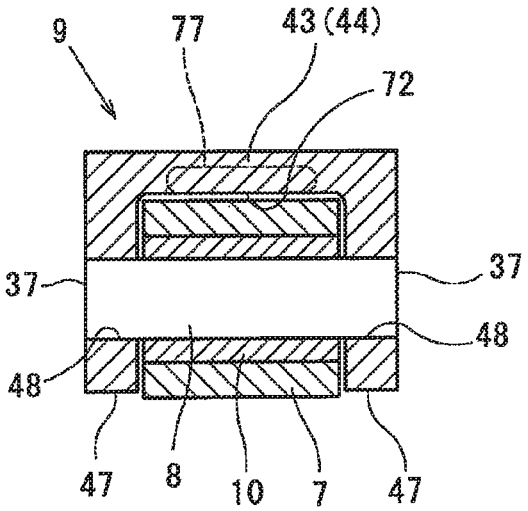

As shown in FIGS. 4A and 4B, the roller releasing portion includes a spherical recessed portion 71, a straight portion 72, and/or the like. The spherical recessed portion 71 forms a gap at a predetermined distance with the outer periphery of the tappet roller 7. The straight portion 72 is in a flat shape located inside the spherical recessed portion 71. The straight portion 72 forms a gap at a predetermined distance with the outer periphery of the tappet roller 7. The spherical recessed portion 71 has a part of a spherical surface having a predetermined curvature radius. The spherical recessed portion 71 is formed to surround a periphery of the straight portion 72. The spherical recessed portion 71 has a reinforcing rib 75 in a recessed curved shape. The reinforcing rib 75 is protruded or projected from the reference surface 74 of the inner wall of the roller accommodation chamber 42 toward the tappet roller 7. The reference surface 74 is in a U-shape represented by the dashed line in FIG. 4A. The straight portion 72 is in a circular shape. The straight portion 72 is located at a center of the ceiling surface of the blockade portion 44. The straight portion 72 is located on the end side of the roller accommodation chamber 42. Similarly to the first embodiment, the two oil supply passages 53 open in the straight portion 72.

Figure 4C:
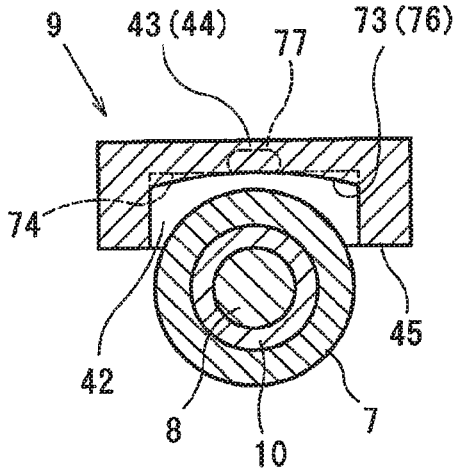
Figure 4D:
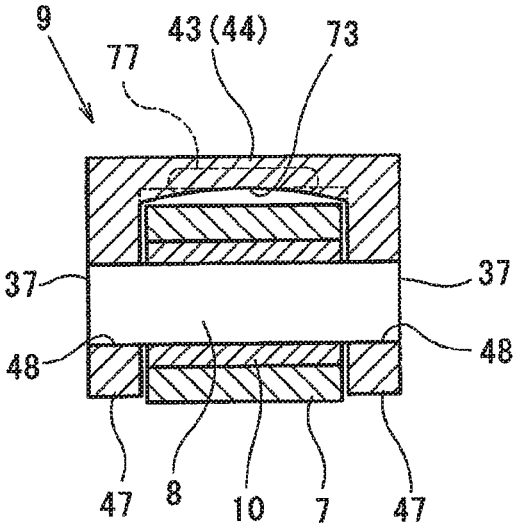

As shown in FIGS. 4C and 4D, the roller releasing portion is formed by the spherical recessed portion 73 and the like. The spherical recessed portion 73 forms the gap at a predetermined distance with the outer periphery of the tappet roller 7. The spherical recessed portion 73 is formed by a part of a spherical surface, which has a predetermined curvature radius. The spherical recessed portion 73 is formed entirely in the ceiling surface of the blockade portion 44 on the end side of the roller accommodation chamber 42. The spherical recessed portion 73 has a reinforcing rib 76 in a recessed curved shape. The reinforcing rib 76 is protruded or projected from the reference surface 74 of the inner wall of the roller accommodation chamber 42 toward the tappet roller 7. The reference surface 74 is a U-shaped portion shown by the dashed line in FIG. 4C. As described above, the present configuration of the plunger actuator of the supply pump according to the present embodiment may enable to restrict the tappet 9 from deformation. In addition, the present configuration may enable to mitigate stress concentration caused in a stress concentric portion 77 of the partition wall 43 of the tappet 9. The stress concentric portion 77 is a portion surrounded by the dashed line in FIGS. 4A to 4D. Therefore, the present configuration may produce the same effect as that of the first embodiment.

Configuration of Third Embodiment

Figure 5:
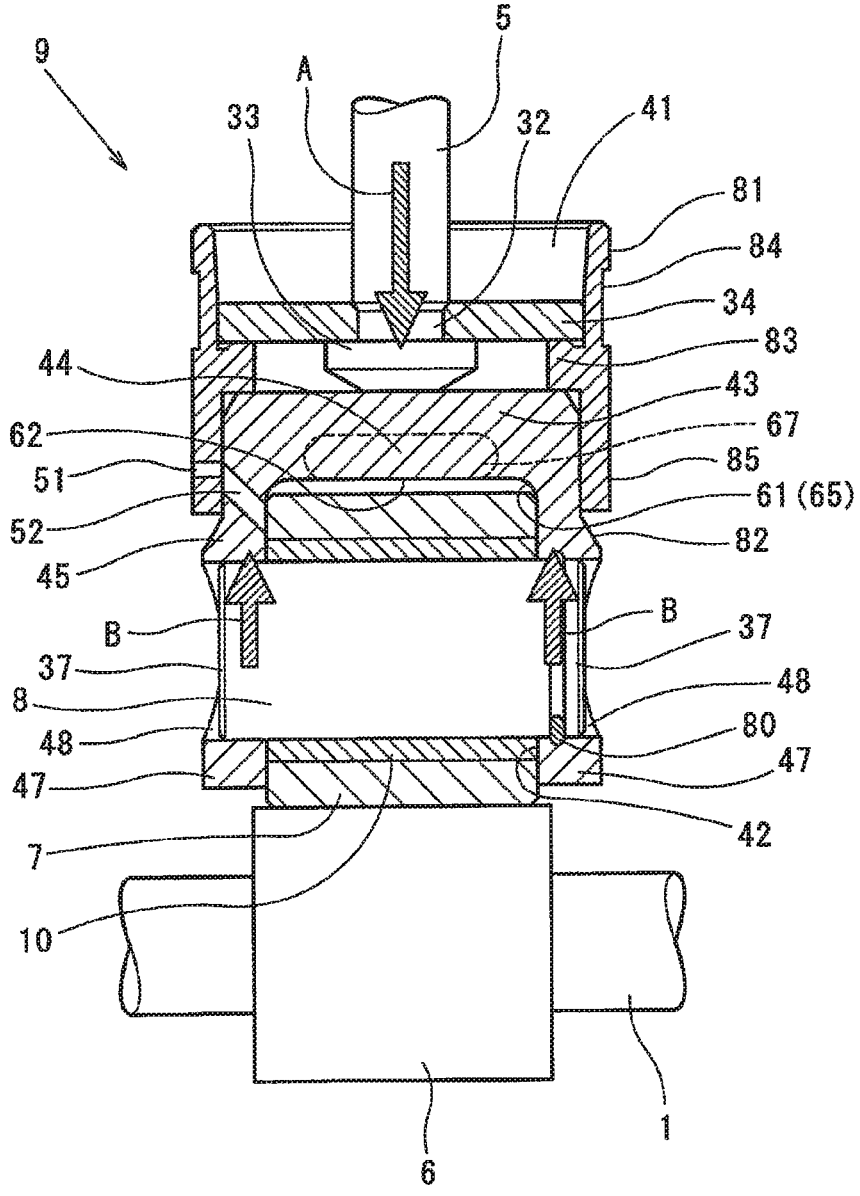
FIG. 5 is a sectional view showing a main configuration of a plunger actuator according to a third embodiment.
Figure 6A:
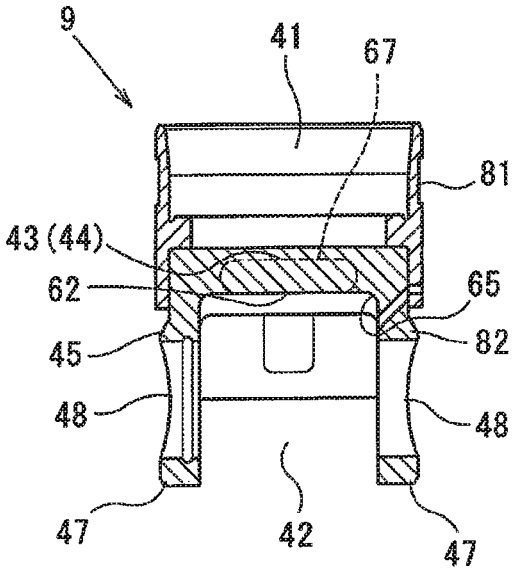
FIGS. 6A to 6D are sectional views each showing the tappet according to the third embodiment.
Figure 6B:
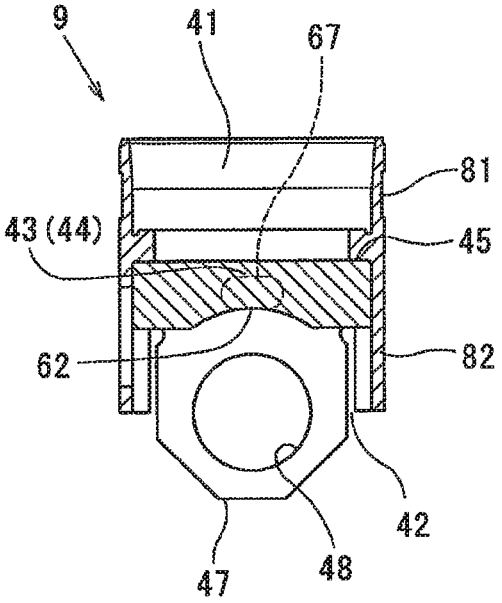
Figure 6C:
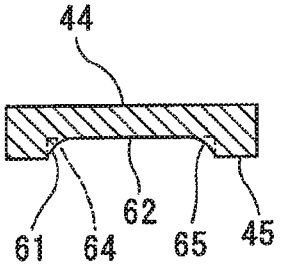
Figure 6D:
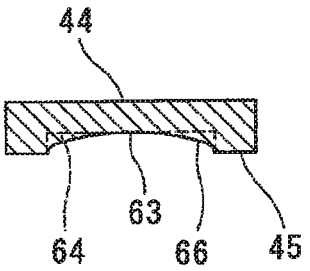
Figure 7A:
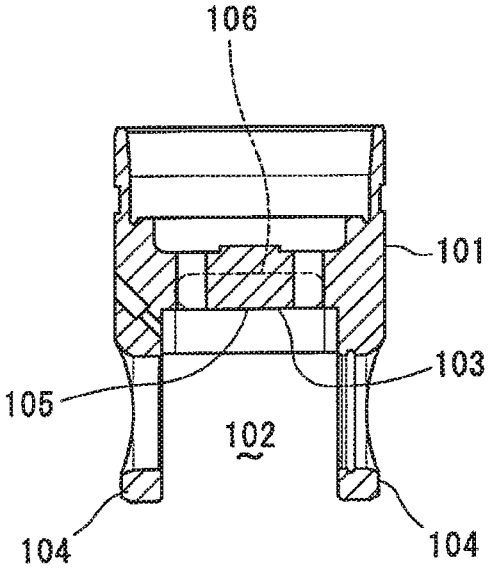
FIGS. 7A and 7B are sectional views each showing a tappet according to a comparative example.
Figure 7B:
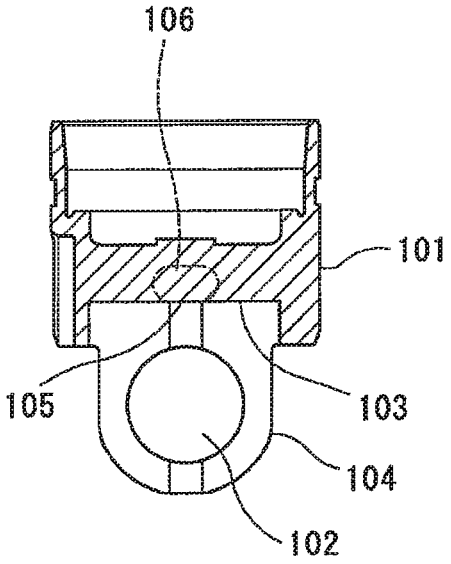
Figure 7C:
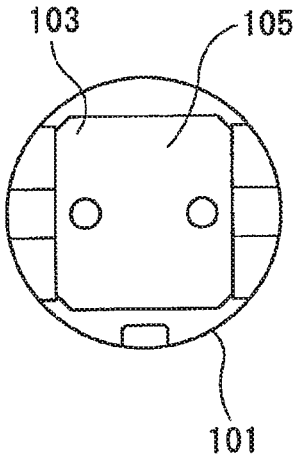
FIG. 7C is a bottom view showing the tappet according to the comparative example.

FIGS. 5 to 6D show a supply pump equipped with a plunger actuator according to a third embodiment of the present disclosure.

The supply pump according to the present embodiment includes the camshaft 1, the housing 2, the cylinder body 3, the plunger 5, and the plunger actuator. The plunger 5 may be equivalent to an actuated object. The plunger 5 is movable along the shape of the cam 6 of the camshaft 1 to move back and forth inside the cylinder barrel 4 of the cylinder body 3. Thus, the plunger 5 draws fuel into the fuel compression chamber 12, pressurizes the fuel, and discharges the fuel. The plunger actuator includes the tappet roller 7, the roller pin 8, the tappet 9, and the roller bush 10. A C-shaped ring 80 is fitted to a groove formed on the outer circumferential periphery of the roller pin 8. The C-shaped ring 80 is to avoid detachment of the roller pin 8 from the tappet 9.

The tappet 9 has a separate configuration and includes a tappet sleeve 81, a tappet body 82, and/or the like. The tappet sleeve 81 is in a tubular shape and is connected with the spring seat 34. The spring seat 34 is mounted to the outer circumferential periphery of the small diameter portion 32 of the plunger 5. The spring seat 34 is movable integrally with the plunger 5. The tappet body 82 is connected with the tappet sleeve 81 and is integrally movable with the tappet sleeve 81. The tappet sleeve 81 has an oil supply passage 51. The oil supply passage 51 communicates the oil supply passage of the housing with the oil supply passage 52 of the tappet body 82. An inner circumferential periphery of the tappet sleeve 81 forms the plunger accommodation chamber 41, which accommodates the tappet contact portion 33 of the plunger 5 and the spring seat 34. The plunger accommodation chamber 41 is in a U-shape.

The tappet sleeve 81 has a sheet retaining portion 83 in an annular shape. The sheet retaining portion 83 retains the spring seat 34. The tappet sleeve 81 has a circumferential sidewall 84 in a tubular shape. The circumferential sidewall 84 is projected from the outer circumferential periphery of the sheet retaining portion 83 toward the plunger 5 on the upper side in the drawing. The tappet sleeve 81 has a fitting wall 85 in a tubular shape. The fitting wall 85 is fitted to an outer circumferential periphery of the tappet body 82. An upper portion of the tappet body 82 in the drawing has a partition wall 43, which partitions the plunger accommodation chamber 41 from the roller accommodation chamber 42. An upper surface of the partition wall 43 is directly in contact with the tappet contact portion 33 of the plunger 5. The tappet body 82 has the blockade portion 44 in a plate shape and the protruded wall portion 45 in a tubular shape. The tappet body 82 has the roller releasing portion, which is to avoid contact with the outer periphery of the tappet roller 7. The roller releasing portion is formed by the inner wall of the roller accommodation chamber 42. That is, the roller releasing portion is formed by the inner wall of the blockade portion 44 and the inner wall of the protruded wall portion 45.

As shown in FIGS. 6A to 6C, the roller releasing portion of the tappet body 82 has the curved recessed portion 61 and the straight portion 62, which is in a flat surface shape. Similarly to the first embodiment, the curved recessed portion 61 has the reinforcing rib 65, which is in a recessed curved shape. The reinforcing rib 65 is projected or protruded from the reference surface 64 of the inner wall of the roller accommodation chamber 42 toward the tappet roller 7. The reference surface 64 is a U-shaped portion shown by the dashed line in FIG. 5 and FIGS. 6C and 6D. As shown in FIG. 6D, the roller releasing portion has the curved recessed portion 63. Similarly to the first embodiment, the curved recessed portion 63 has the reinforcing rib 66 in a recessed curved shape. The reinforcing rib 66 is projected or protruded from the reference surface 64 of the inner wall of the roller accommodation chamber 42 toward the tappet roller 7. The reference surface 64 is a U-shaped portion shown by the dashed line in FIG. 5 and FIGS. 6A and 6B.

As described above, the configuration of the plunger actuator of the supply pump according to the present embodiment may mitigate a stress applied to the stress concentric portion 67 of the tappet 9 thereby to produce an effect similarly to the first and second embodiments, while maintaining the mountability of the supply pump to a vehicle such as an automobile, an engine, and/or the like. The stress concentric portion 67 is the portion surrounded by the dashed line in FIG. 5 and FIGS. 6A and 6B. It is noted that, the curved recessed portion 61, the straight portion 62, and the reinforcing rib 65, may be replaced with the spherical recessed portion 71, the straight portion 72, and the reinforcing rib 75, respectively. In addition, the curved recessed portion 63 and the reinforcing rib 66 may be replaced with the spherical recessed portion 73 and the reinforcing rib 76, respectively.

Modification

In the above-described embodiments, the actuator, which moves the plunger back and forth in the high-pressure fuel pump, is applied to the plunger actuator, which actuates the plunger of the supply pump for a common-rail fuel injection system. It is noted that, the actuator, which moves the plunger back and forth in the high-pressure fuel pump, may be applied to a plunger actuator to actuate a plunger in a distributed fuel injection pump for a fuel injection device, which does not include a common rail, and/or to a plunger actuator to actuate a plunger in a sequential fuel injection pump.

In the above embodiments, the solenoid valve is exemplified with a normally-close type electromagnetic pump control valve (PCV) to control a pump discharge quantity. It is noted that, the solenoid valve may be a normally-open type electromagnetic pump control valve (PCV) to control a pump discharge quantity. An electromagnetic suction control valve (SCV) may be employed instead of the PCV. A fuel inlet valve, which controls a quantity of fuel drawn into the compression chamber, may be employed instead of the solenoid valve.

In the above embodiments, the actuator equipped component of the present disclosure is exemplified with the supply pump equipped with the plunger actuator. It is noted that, the actuator equipped component of the present disclosure may be an intake air valve control device. The intake air valve control device may be equipped with an intake valve actuator, which is to convert a rotary motion of a cam of a camshaft into a reciprocating motion of an intake valve (actuated object) to move the intake valve back and forth. The actuator equipped component of the present disclosure may be an exhaust valve control device equipped with an exhaust valve actuator. The exhaust valve actuator converts a rotary motion of a cam of a camshaft into a reciprocating motion of an exhaust valve (actuated object) to move the exhaust valve back and forth.

In the above embodiments, the actuator equipped component of the present disclosure is exemplified with the supply pump, which is equipped with the plunger actuator. The plunger actuator is actuated with the cam 6 of the camshaft 1, which is rotated in synchronization with rotation of the engine crankshaft. It is noted that, the actuator equipped component of the present disclosure may be a supply pump, which is equipped with a plunger actuator. The plunger actuator is rotated in synchronization with rotation of the engine crankshaft and is reciprocated with the cam 6 of the camshaft of an intake valve control device or an exhaust valve control device. The camshaft 1 of the supply pump may be rotated with a balance shaft of an internal combustion engine.

In the embodiments, the feed pump is equipped to an upstream side of the intake port of the high-pressure fuel pump relative to the fuel flow. It is noted that, the feed pump may be accommodated in the pump housing of the high-pressure fuel pump. In this case, the feed pump may be actuated by rotation of the camshaft 1, which is caused by rotation of an engine crankshaft, thereby to pump low-pressure fuel from the fuel tank through the intake port of the high-pressure fuel pump. The plunger 5 may be integrally formed with the tappet 9.

In the embodiments, the roller releasing portion of the tappet 9 includes the curved recessed portion 61, the straight portion 62, the reinforcing rib 65, and the like. Alternatively, the roller releasing portion of the tappet 9 includes the curved recessed portion 63, the reinforcing rib 66, and the like. It is noted that, the roller releasing portion of the tappet 9 may include at least one of the curved recessed portion 61, the straight portion 62, the reinforcing rib 65, and the like. The roller releasing portion of the tappet 9 may include at least one of the curved recessed portion 63 and the reinforcing ribs 66.

In the embodiments, the roller releasing portion of the tappet 9 includes the curved recessed portion 71, the straight portion 72, the reinforcing rib 75, and the like. Alternatively, the roller releasing portion of the tappet 9 includes the curved recessed portion 73, the reinforcing rib 76, and the like. It is noted that, the roller releasing portion of the tappet 9 may include at least one of the curved recessed portion 71, the straight portion 72, the reinforcing rib 75, and the like. Alternatively, the roller releasing portion of the tappet 9 may include at least one of the curved recessed portion 73, the reinforcing rib 76, and the like.

The actuator equipped component according to the present disclosure includes the tappet having the roller releasing portion. The roller releasing portion is equipped with the reinforcing rib in the recessed curved shape. The reinforcing rib is projected from the reference surface of the inner wall of the accommodation chamber toward the roller. The present configuration may enable to restrain deformation of the tappet, without increasing thickens of the tappet, thereby to enable to mitigate stress concentration in a stress concentric portion of the tappet. The present configuration may enable to restrict enlargement of the actuator in the vertical direction along the movable direction of the actuated object in which the actuated object is movable back and forth. Therefore, the present configuration may enhance mountability of the actuated object in a vehicle or to an internal combustion engine. In addition, the present configuration may mitigate a stress caused in the stress concentric portion of the tappet to enhance durability of the tappet, while maintaining mountability of the actuated object in a vehicle or to an internal combustion engine.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An actuator equipped component comprising:

a camshaft including a cam configured to be rotated by an internal combustion engine;

an actuated object movable back and forth along a shape of the cam; and an actuator configured to convert a rotary motion of the cam into a reciprocating motion of the actuated object and to actuate the object to move back and forth, wherein the actuator includes a roller in contact with the cam, a roller pin rotationally supporting the roller, and a tappet connected with the roller via the roller pin and integrally movable with the roller and the roller pin, the tappet movable back and forth integrally with the actuated object, wherein the tappet has an accommodation chamber that rotatably houses the roller and is defined by:

a first wall that serves as a flat bottom of the accommodation chamber;

a second wall that has a tubular shape; and a spherical surface that surrounds the first wall and connects the first wall and the second wall to each other, and two arms that extend from the second wall toward the cam, the two arms facing each other along an axial direction of the roller that is interposed between the two arms, and the spherical surface has a cross-section, which is perpendicular to the axial direction of the roller, with two curved portions, wherein each of the two curved portions defines a portion of a common circle.

2. The actuator equipped component according to claim 1, wherein each of the two curved portions has a predetermined curvature radius that is greater than that of the roller.

3. The actuator equipped component according to claim 1, wherein the roller pin includes projected shaft portions projected outward from both end surfaces of the roller in a rotational axis direction, and the two arms rotatably support the projected shaft portions.

4. The actuator equipped component according to claim 1, wherein the actuated object is a plunger movable back and forth along the shape of the cam, and the plunger is inserted in a cylinder of a high-pressure fuel pump and supported in the cylinder to pressure feed fuel to an internal combustion engine.

* * * * *